US007503802B2

(12) United States Patent
Tu et al.

(10) Patent No.: US 7,503,802 B2
(45) Date of Patent: Mar. 17, 2009

(54) ELECTRICAL CONNECTOR ASSEMBLY HAVING MULTI-PORT FOR INTERFACING DIFFERENT MATING CONNECTORS

(75) Inventors: Hou-Chun Tu, Kunshan (CN); David Tso-Chin Ko, Fullerton, CA (US); Hai-Wei Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/009,683

(22) Filed: Jan. 22, 2008

(65) Prior Publication Data

US 2008/0214045 A1 Sep. 4, 2008

(51) Int. Cl.
*H01R 13/60* (2006.01)

(52) U.S. Cl. ..... 439/540.1; 439/731; 439/906

(58) Field of Classification Search ..... 439/540.1, 439/607, 731, 906

See application file for complete search history.

(56) References Cited

U.S. PATENT DOCUMENTS

| | | | | |
|---|---|---|---|---|
| 4,215,236 | A * | 7/1980 | Reiser | 439/540.1 |
| 6,213,815 | B1 * | 4/2001 | Wu | 439/731 |
| 6,846,200 | B1 * | 1/2005 | Hsu | 439/540.1 |
| 6,887,098 | B1 * | 5/2005 | Luo et al. | 439/540.1 |
| 7,045,727 | B2 * | 5/2006 | Chiang et al. | 439/906 |
| 7,118,414 | B2 | 10/2006 | Spears et al. | |
| 7,140,911 | B1 * | 11/2006 | Rector et al. | 439/540.1 |

* cited by examiner

*Primary Examiner*—Tho D Ta
(74) *Attorney, Agent, or Firm*—Wei Te Chung

(57) ABSTRACT

An electrical connector assembly (100) includes a connector holder (2) including a low cover (21) engaging with an up cover (22) to define a hollow portion; a number of connectors (11, 12, 13, 14, 15) being received in the hollow portion of the connector holder; a metal shell (4) enclosing a receiving space to accommodate the connector holder (2) and at least one cable retainer (31) extending rearward from a back edge of the connector holder (2).

7 Claims, 4 Drawing Sheets

ELECTRICAL CONNECTOR ASSEMBLY HAVING MULTI-PORT FOR INTERFACING DIFFERENT MATING CONNECTORS

BACKGROUND OF THE INVENTION

1. Field of the Invention

The present invention generally relates to an electrical connector assembly, and more particularly to an electrical connector assembly with multi-ports for interfacing with different mating connectors.

2. Description of Related Art

Computers have become an essential part of modern business. Through advances in chip design and manufacture, the cost of personal computers has dropped dramatically in recent years to the point where such personal computers are affordable by most consumers. As part of an effort to lower manufacturing costs, manufacturers have been looking for ways to more easily, reliably and flexibly assemble their computers.

While much attention has been paid to advances in chip design and manufacture, comparatively little effort has been put into optimizing the input and output connections to a personal computer. The input connections for a personal computer often involve input ports for a keyboard, mouse, joystick, microphone, video feed and, more recently, multi-use universal serial bus ("USB") connectors. The output connections for a personal computer often involve output ports for a printer, video monitor, modem and audio loudspeakers.

Thus far, a patch work of approaches has been used for installing input/output connector ports onto a computer. Historically, connector ports have been located at the rear of the computer housing where they are difficult for the user to access. In the case of audio and visual connector ports, they have often been built as part an electrical circuit-board which must then be screwed onto the computer housing. Other connectors, such as USB and high speed communications connectors, have been wrapped in a plastic plug which again must be screwed onto the computer housing. All of this screwing of connector ports onto a computer housing is labor intensive and, therefore, expensive. Moreover, present techniques for installing connector ports onto a computer housing allow little flexibility to change the type of connector ports being used if the manufacturer wants to use the same connector assembly for both high end computers with many connector ports and low end computers with fewer connector ports.

U.S. Pat. No. 7,118,414 B2 issued to Spears on Oct. 10, 2006 discloses an input/output connector assembly which uses connector port holder that can easily be snapped into a metal retaining bracket. In one preferred embodiment, the bracket of the present invention is mounted on the front panel of a personal computer tower. Connected to the bracket is a first connector port holder with two USB connector ports, a second connector port holder with an IEEE 1394 high speed communication port, a third connector port holder with three audio ports (e.g., audio in, audio out and microphone) and a fourth connector port holder with two video ports (e.g., the so-called RCA composite video and S-video). However, the aforementioned connector port holders are integrally combined together via ultrasonic welding technique, and once one of the port involved in the connector port holder is broken, it may cause the whole connector port holder to be unable to hold the whole, and need to be replaced, for it difficult to repair such integral connector port holder.

Hence, an improved electrical connector assembly is highly desired to overcome the disadvantages of the related art.

SUMMARY OF THE INVENTION

Accordingly, an object of the present invention is to provide an electrical connector assembly which is easily manufactured and of lower cost.

In order to achieve the object set forth, an electrical connector assembly comprising a connector holder including a low cover engaging with an up cover to define a hollow portion; a number of connectors being received in the hollow portion of the connector holder; a metal shell enclosing a receiving space to accommodate the connector holder; and wherein at least one cable retainer extend rearward from a back edge of the connector holder.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
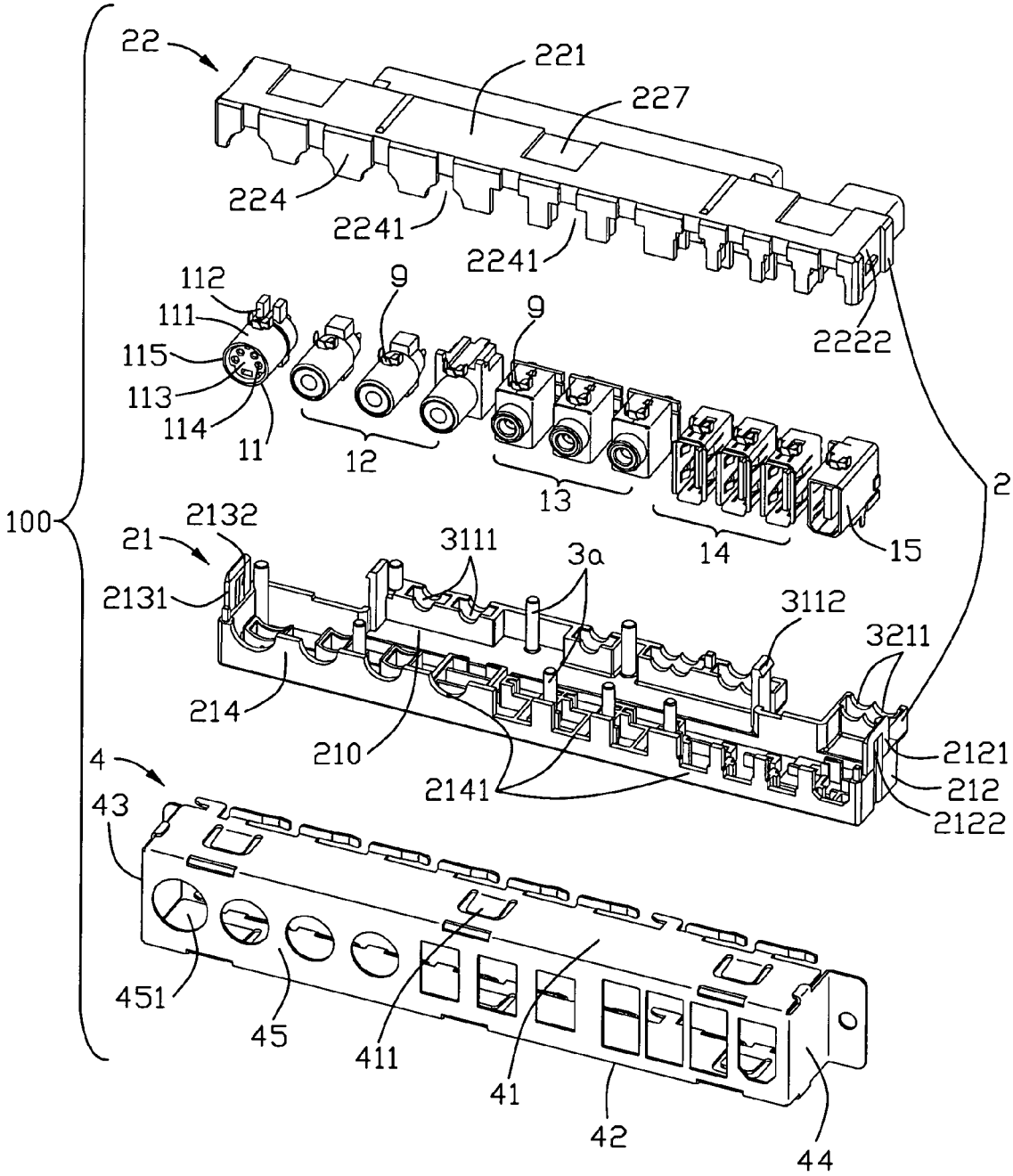
FIG. 1 is an exploded, perspective view of an electrical connector assembly in accordance with the present invention.
Figure 2:
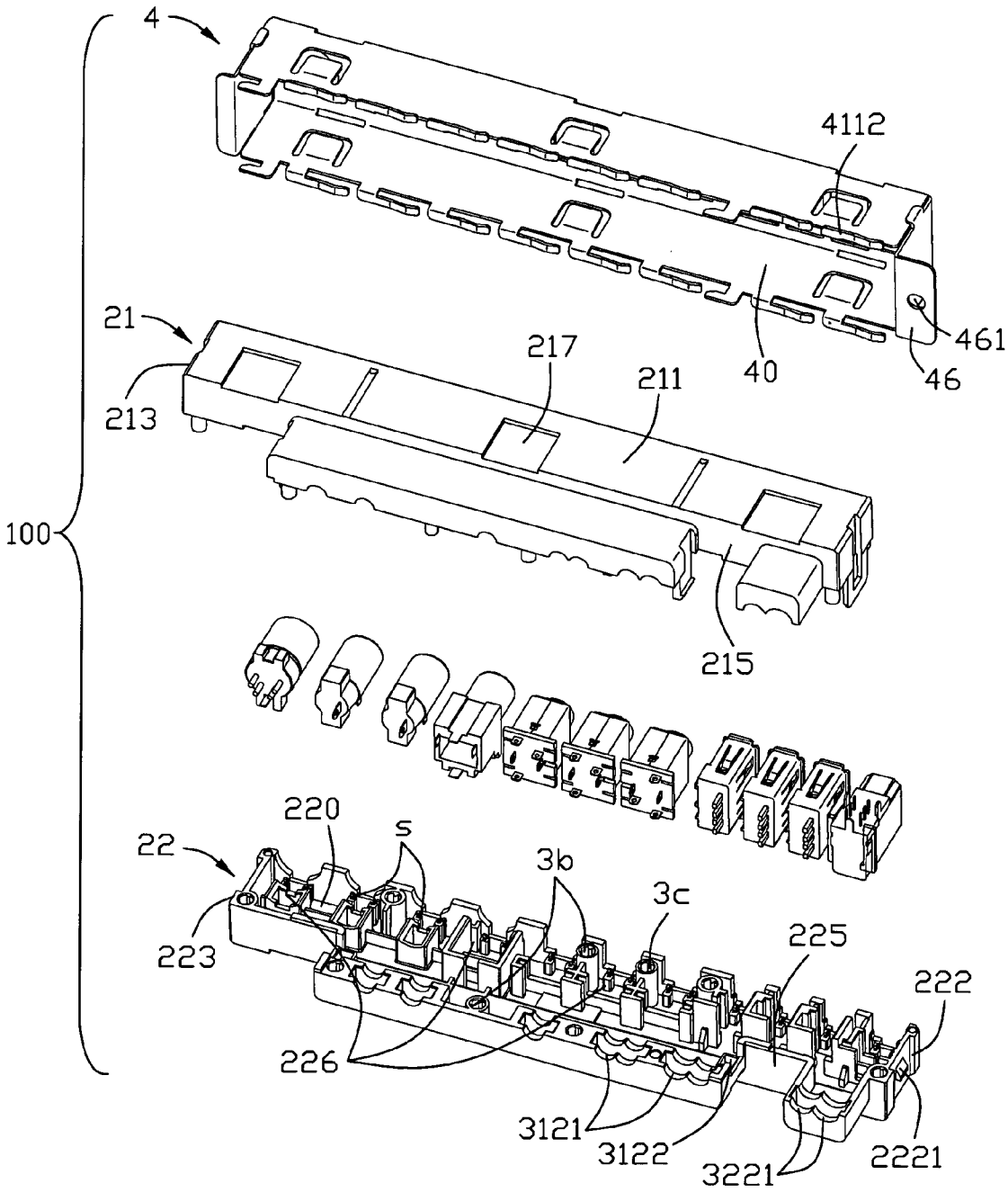
FIG. 2 is similar to FIG. 1, but viewed from another aspect.
Figure 3:
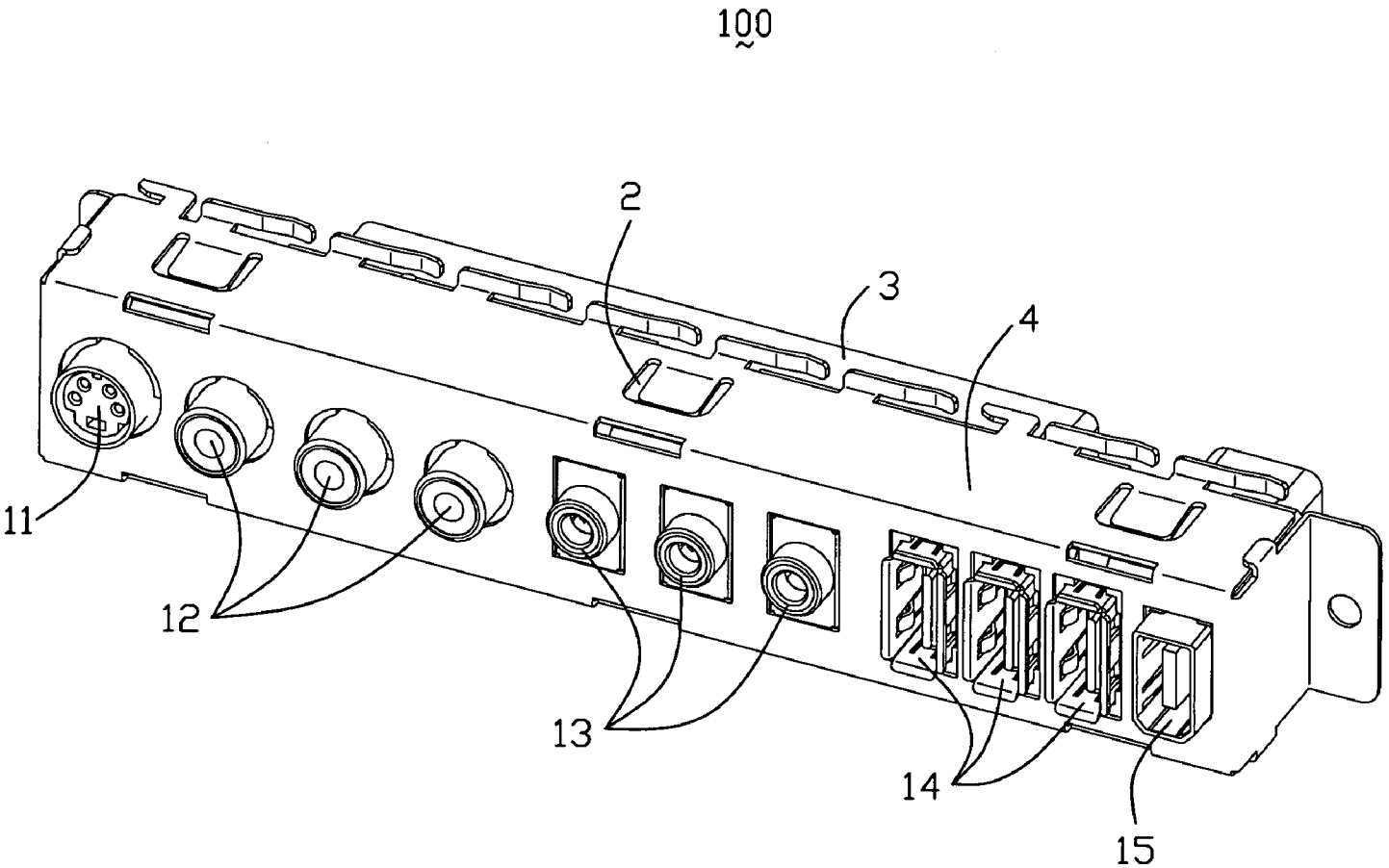
FIG. 3 is an assembled, perspective view of FIG. 1.
Figure 4:
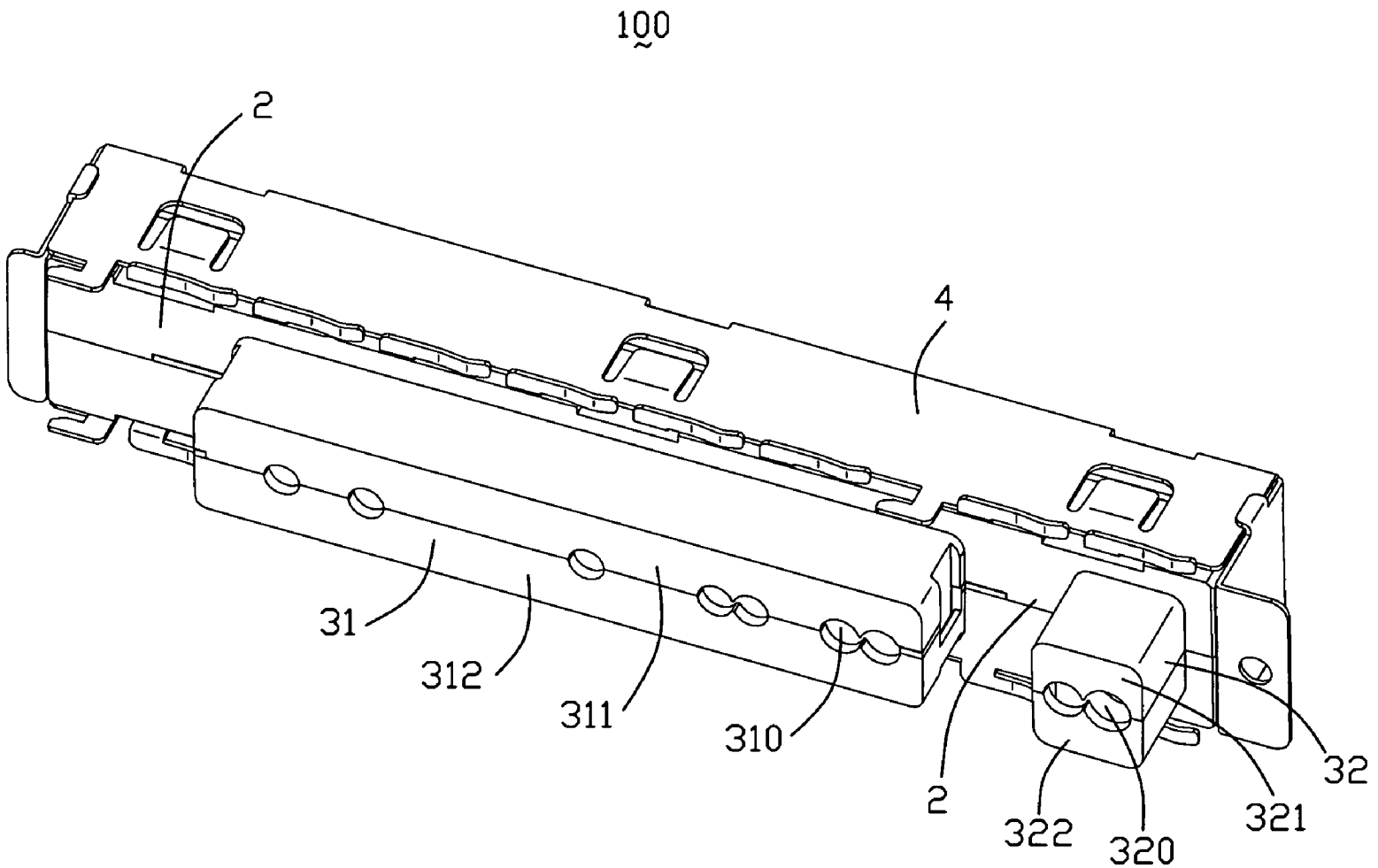
FIG. 4 is similar to FIG. 3, but viewed from another aspect.

Referring to FIGS. 1-4, an electrical connector assembly 100 of a preferred embodiment in accordance with the present invention comprises a number of different connectors including a S-video connector 11, three RCA video connectors 12, three audio connectors 13, three USB connectors 14 and a IEEE 1394 connector 15, a connector holder 2, a cable retainer 3 and a metal shell 4.

The S-video connector 11 has a forward mating portion 111, including an insulator 113, a number of contacts 114 received in the insulator 113 and a metal shell 115 enclosing outward of the insulator 113. A mounting portion 112 is formed at rear section of the insulator 113. The RCA video connectors 12, audio connectors 13, USB connectors 14 and the IEEE 1394 connector 15 both have similar structures as aforementioned recited, excepted for outer profiles and interior configurations thereof. Those are acknowledged by a person of skill, and detailed descriptions are omitted hereby.

The connector holder 2 has a low cover 21 and an up cover 22. The low cover 21 includes a base portion 211, a pair of lateral walls 212, 213 respectively upright extending from lateral edges of the base portion 211, a front wall 214 and a back wall 215 extending upright from front and back edges of the base portion 211 to corporately define a first hollow portion 210. A pair of clasp portions 2121, 2131 extend upward from top edges of the lateral walls 212, 213, with cavities 2122, 2132 defined therein respectively. A number of semi-cavities 2141 are defined in the front wall 214. Several positioning posts 3*a* are disposed in the-first hollow portion 210, extending upward from upper surface of the base portion 211, respectively.

The up cover 22 includes a base portion 221, a pair of lateral walls 222, 223 respectively downward extending from lateral edges of the base portion 221, a front wall 224 and a back wall 225 extending downward from front and back edges of the base portion 221 to corporately define a second hollow portion 220. A number of connector receiving slots 226 arranged in a row are located in the second hollow portion 220. A pair of depression portions 2222 are defined in outer sections of the pair of lateral walls 222, 223 and recessed inwardly from outer surfaces thereof, respectively. A pair of protrusion members 2221 are located at middle areas of the depression portions 2222 respectively. A number of semi-cavities 2241 are defined in the front wall 224. Several pillars (not numbered) are disposed in the second hollow portion 220, extending downward from lower surface of the base portion 221, each pillar has a positioning cavity 3*b* therein.

The cable retainer 3 includes a first sub-retainer 31 and a second sub-retainer 32 spaced apart from one another along horizontal direction and respectively rearward extending from back edge of the connector holder 2. The first sub-retainer 31 includes a low piece 311 and an up piece 312. The low piece 311 defines several first grooves 3111 and the up piece 312 defines several second grooves 3121 aligning with the first grooves 3111 respectively to form a several cable receiving passages 310. The second sub-retainer 32 also includes a low piece 321 and an up piece 322. The low piece 321 defines a pair of first grooves 3211 and the up piece 322 defines several second grooves 3221 aligning with the first grooves 3211 respectively to form a pair cable receiving passages 320. A pair of latch members 3112 are located at lateral sides of the low piece 311 of the first sub-retainer 31, while a pair of latch cavities 3122 are defined in lateral sides of the up piece 312 of the first sub-retainer 32 to engage with the pair of latch members 3112. A number of positioning posts 3 a are arranged on the low piece 311 of the first sub-retainer 31 and the base portion 211 of the lower cover 21, and a number of positioning cavities 3*b* are defined in the up piece 312 of the first sub-retainer 31 and the base portion 221 of the up cover 22 to receive the positioning posts 3*a*. Each positioning cavity 3*b* further forms a number of tiny vertical ribs 3*c* on interior surface thereof to enhance retaining force between the positioning post 3*a* and positioning cavity 3*b*.

The metal shell 4 is stamped of a metal sheet, including a top side 41, a bottom side 42, a front side 45 and a pair of transversal sides 43, 44 to form a receiving space 40. The front side 45 of the metal shell defines a number of through holes 451 for mating portions of the electrical connectors passing through. A number of spring tabs 411 are formed on the top side 41 and a bottom side 42, extending into the receiving space 40. Several slim bars 4112 are formed at rear edges of the top side 41 and the bottom side 42. A pair of ear portions 46 are formed at rear edges of the pair of the transversal sides 43, 44, with a pair of holes 461 defined therein.

A number of grounding members g are assembled to slots s of the up cover 22, contacting with metal shells of the connectors, and further contacting the metal shell 4 to form grounding circuit.

When assembly, the S-video connector 11, the RCA video connectors 12, the Audio connectors 13, the USB connectors 14 and the IEEE 1394 connector 15 are soldered to cables (not shown) to form electrical connection. Then the aforementioned connectors are put into the connector receiving slots 226 of the second hollow portion 220 of the up cover 22, with the mating portions of the connector extending outward through the semi-cavities 2241 of the front wall 224. The low cover 21 is assembled to the up cover 22 along vertical direction, with the positioning posts 3*a* inserted into the positioning cavities 3*b*, the pair of protrusion members 2221 locked into the cavities 2132, 2122 of the clasp portions 2131, 2121, simultaneously, the cables exit outward through the cable receiving passages 310, 320 of the cable retainer 3, with partial thereof being fixed in the cable receiving passages 310, 320. Then the connector holder 2 is assembled into the receiving space 40 of the metal shell 4, with mating portions of the connectors forward extending outside via holes 451 of the front side 45 of metal shell 4, the cable retainers 31, 32 rearward extending outward of the receiving space 40 of the metal shell 4, the spring tabs 411 locked into cavities 217, 227 of outside section of the base portions 211, 221.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a connector holder including a low cover engaging with an up cover to define a hollow portion;

a number of connectors being received in the hollow portion of the connector holder;

a metal shell enclosing a receiving space to accommodate the connector holder; and wherein at least one cable retainer extend rearward from a back edge of the connector holder;

wherein the low cover has a pair of lateral walls, with a pair of clasp portions extending upward from top edges thereof, each of the clasp portions further defining a cavity therein, wherein , the up cover has a pair of lateral walls, with a pair of protrusion members formed thereon to lock into the cavities of the clasp portion;

wherein each of the pair of lateral wall respectively define a depression portion recessed inwardly from an outer surface thereof, with the protrusion member located at middle area of the depression portion, wherein the clasp portion is located in the depression portion, with the cavity thereof receiving the protrusion member;

wherein the low cover has base portion, with a number of positioning posts upward extending from a top surface thereof, wherein the up cover has base portion, with a number of pillars downward extending from a bottom surface thereof, each of the pillar having a cavity to receiving corresponding post;

wherein each cavity of the pillar further has a number of vertical ribs therein to increase combination between the post and the cavity of the pillar;

wherein the cable retainer defines a number of receiving passages communicates with the hollow portion and an outside;

wherein the cable retainer includes a low piece extending rearward from back surface of the lower cover and an up piece extending rearward from back surface of the up cover, wherein the low piece defines several first grooves and the up piece defines several second grooves aligning with the first grooves respectively to form the cable receiving passages;

wherein at least one positioning post is arranged on the low piece of the cable retainer, wherein at least a positioning cavity is defined in the up piece of the cable retainer to receive the positioning post.

2. The electrical connector assembly as claimed in claim 1, wherein the up cover has a number of connector receiving slots arranged in a row and located in a second hollow portion thereof to retain the connectors.

3. The electrical connector assembly as claimed in claim 1, wherein a pair of latch members are formed at lateral sides of the low piece of the cable retainer, wherein a pair of latch cavities are defined in lateral sides of the up piece of the cable retainer to engage with the pair of latch members.

4. The electrical connector assembly as claimed in claim 1, wherein the cable retainer rearward protrudes outside of the receiving space of the metal shell.

5. The electrical connector assembly as claimed in claim 1, wherein a pair of cable retainers are spaced apart from one another along horizontal direction and respectively rearward extending from the back edge of the connector holder.

6. The electrical connector assembly as claimed in claim 1, wherein mating portions of the electrical connectors forwardly extend outside of the hollow portion of the connector holder.

7. The electrical connector assembly as claimed in claim 6, wherein the metal shell includes a top side, a bottom side, a front side and a pair of transversal sides to form the receiving space, wherein the front side of the metal shell defines a number of through holes to allow mating portions of the electrical connectors passing through.

* * * * *